US008137082B2

(12) United States Patent
Campbell

(10) Patent No.: US 8,137,082 B2
(45) Date of Patent: Mar. 20, 2012

(54) AIR BLOWER ASSEMBLY

(75) Inventor: Graham J. Campbell, Stevenson Ranch, CA (US)

(73) Assignee: G-G Distribution and Development Co., Inc., Valencia, CA (US)

( * ) Notice: Subject to any disclaimer, the term of this patent is extended or adjusted under 35 U.S.C. 154(b) by 729 days.

(21) Appl. No.: 11/961,888

(22) Filed: Dec. 20, 2007

(65) Prior Publication Data

US 2009/0162226 A1 Jun. 25, 2009

(51) Int. Cl.
*F04D 29/60* (2006.01)

(52) U.S. Cl. ..... 417/423.15; 417/363; 417/423.1; 417/423.14; 277/641

(58) Field of Classification Search ..... 417/363, 417/423.1, 423.14, 423.15; 271/641; 310/84, 310/154.09; 277/641
See application file for complete search history.

(56) References Cited

U.S. PATENT DOCUMENTS

| | | | | |
|---|---|---|---|---|
| 2,286,993 | A * | 6/1942 | Naul | 310/432 |
| 3,992,133 | A * | 11/1976 | Brunner | 417/366 |
| 4,133,461 | A * | 1/1979 | Vercelot | 222/402.24 |
| 4,950,133 | A | 8/1990 | Sargent | |
| 4,964,787 | A * | 10/1990 | Hoover | 417/363 |
| 5,327,036 | A * | 7/1994 | Carey | 310/89 |
| 5,533,704 | A * | 7/1996 | Fischinger et al. | 248/603 |
| 6,045,112 | A * | 4/2000 | Kirkwood | 248/634 |
| 6,155,801 | A | 12/2000 | Elnar | |
| 6,386,845 | B1 | 5/2002 | Bedard | |
| 7,550,888 | B2 * | 6/2009 | Ito | 310/91 |
| 2003/0117030 | A1 * | 6/2003 | Agnes et al. | 310/89 |
| 2004/0027011 | A1 * | 2/2004 | Bostwick et al. | 310/58 |
| 2004/0216907 | A1 * | 11/2004 | Happ et al. | 173/217 |
| 2007/0284954 | A1 * | 12/2007 | Lin et al. | 310/58 |
| 2008/0304986 | A1 * | 12/2008 | Kenyon et al. | 417/423.12 |
| 2009/0058209 | A1 * | 3/2009 | Baranowski et al. | 310/91 |
| 2009/0060763 | A1 * | 3/2009 | Rush et al. | 417/423.14 |

FOREIGN PATENT DOCUMENTS

JP 07313408 A * 12/1995

* cited by examiner

*Primary Examiner* — Devon C Kramer
*Assistant Examiner* — Leonard Weinstein
(74) *Attorney, Agent, or Firm* — Larry K. Roberts

(57) ABSTRACT

An exemplary embodiment of an air blower includes an electrically powered motor including a motor housing. A blower housing has first and second housing structures, each having inwardly facing, spaced ribs, and configured to surround the motor assembly in an assembled configuration. The ribs on the first and second housing structures register the radial and axial position of the motor housing inside the housing.

12 Claims, 7 Drawing Sheets

AIR BLOWER ASSEMBLY

BACKGROUND

Air blowers are used in various applications, including for example bathing installations, such as whirlpool baths and spas. The air blower assembly disclosed herein is particularly suited to such applications, although it is to be understood that the air blower assembly may have utility in many other applications.

DETAILED DESCRIPTION

Figure 1:
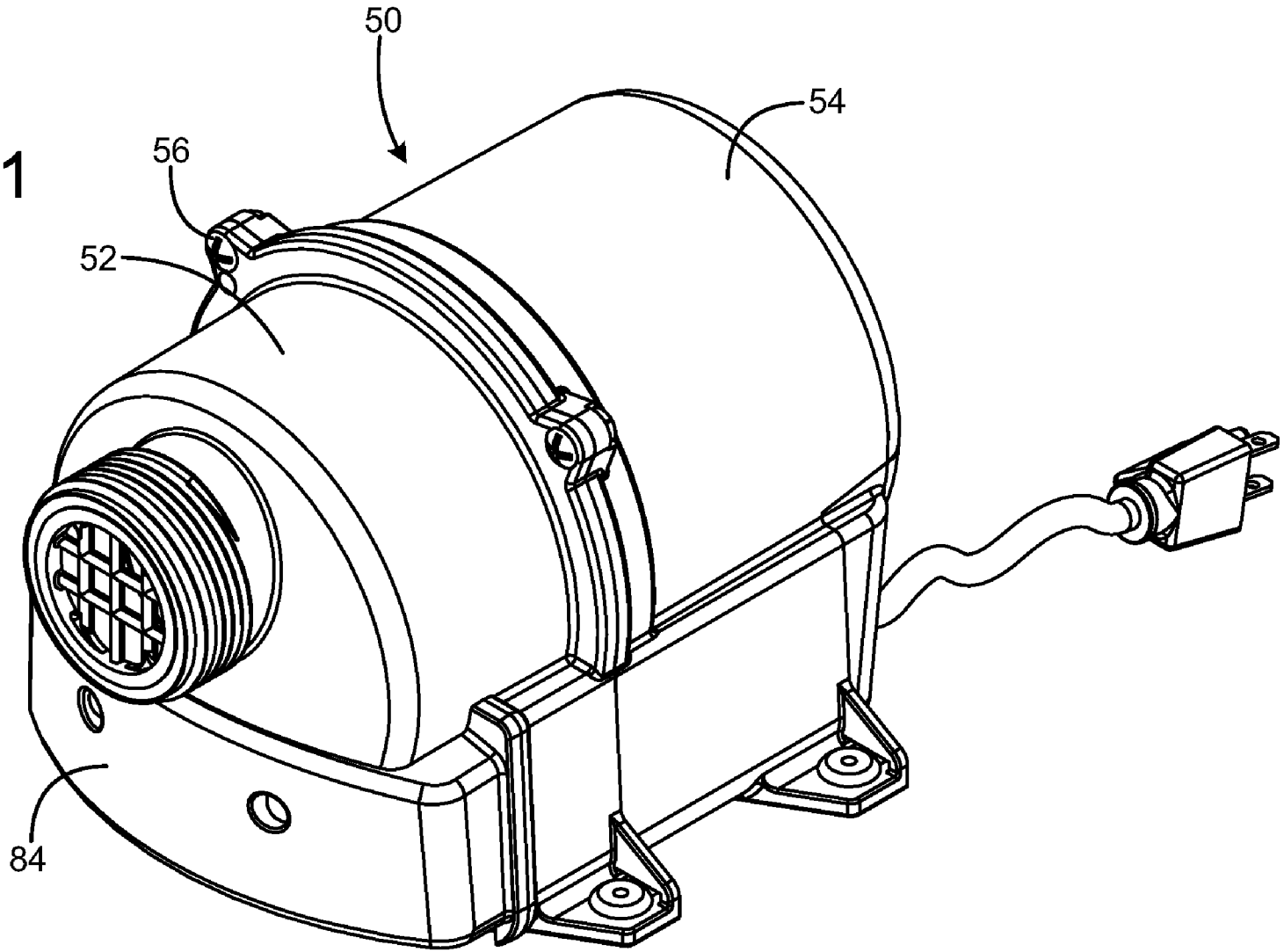
FIG. 1 is an isometric view of an exemplary embodiment of an air blower.

In the following detailed description and in the several figures of the drawing, like elements are identified with like reference numerals.

An exemplary embodiment of an air blower 50 is illustrated in FIGS. 1-6B. The blower includes first and second housing structures 52 and 54, which are configured to support and house a blower motor assembly 70, which may include an electric motor with a shaft, and an impeller fan mounted on or driven by the motor. The housing structures are secured together, along with a sealing gasket 60, in an assembled condition by threaded fasteners 56. The sealing gasket 60 includes a flange portion 62 which is captured between mating interlocking surfaces of the two housing structures.

Figure 3:
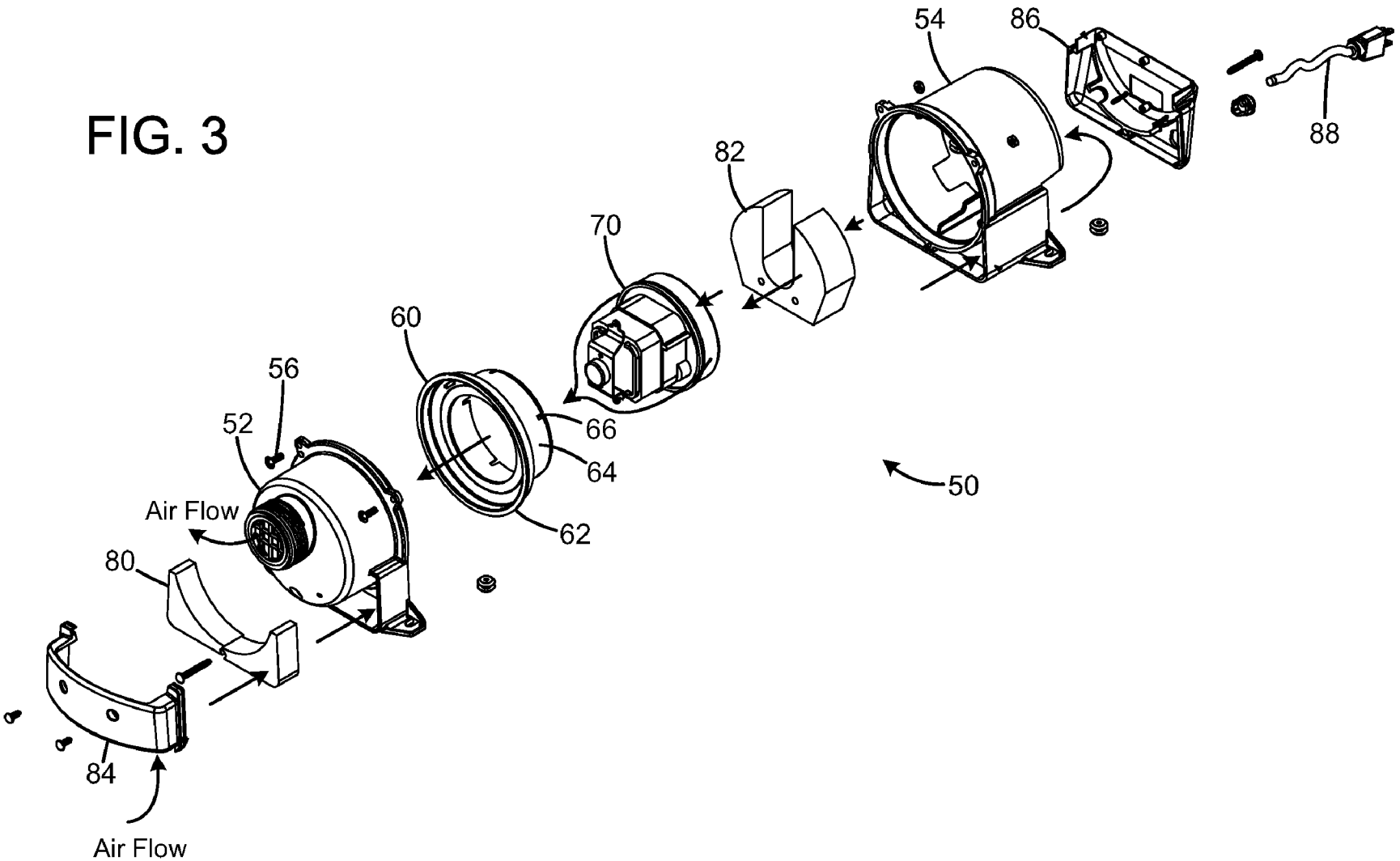
FIG. 3 is an isometric exploded view of the air blower of FIG. 1.

FIG. 3 depicts parts of an exemplary embodiment of an air blower 50. In addition to the first and second housing structures 52 and 54, the gasket 60 and motor assembly 70, the blower includes a first cover 84 and foam member 80. The foam member 80 is fitted against the exterior of the housing structure 52 to provide sound insulation and dirt filtration, and a cover 84 is attached to the first housing structure over the foam member 80. The blower 50 may also include an intake foam member 82 which is positioned inside the second housing structure 54, so that the end surface 70-4 of the motor housing 70-1 is positioned against the intake foam member. The foam member 82 may provide sound insulation and dirt filtration functions in an exemplary embodiment. One or both of the foam members 80 and 82 may be omitted in some embodiments.

A second cover 86 is attached to the second housing structure 54. An electrical power supply wiring 88 is passed through a rear cover 86 (FIG. 3) to the motor assembly 70 to provide a source of electrical power for the motor.

In an exemplary embodiment of an air blower, the motor assembly is secured in position within the housing structures 52 and 54 by the cooperative engagement of internal rib surfaces of the housing structures and the gasket, without the use of separate clamps or fasteners. This simplifies the assembly of the blower and reduces a part count.

In an exemplary embodiment, the gasket 60 may be fabricated of a flexible material such as flexible PVC or other suitable elastomer. The housing structures 52 and 54 may be fabricated from a rigid plastic material in one exemplary embodiment.

The gasket 60 in an exemplary embodiment defines a central opening 60A and a tubular gasket portion 64 which are sized to receive in a tight fit the housing portion 70-1 of the motor assembly. The tubular gasket portion 64 extends into the second housing structure 54, into which the motor assembly 70 is fitted. The tubular portion 64 may have a longitudinal length sufficient to extend past the motor housing portion 70-1 and has slots 66 formed therein.

Figure 6A:
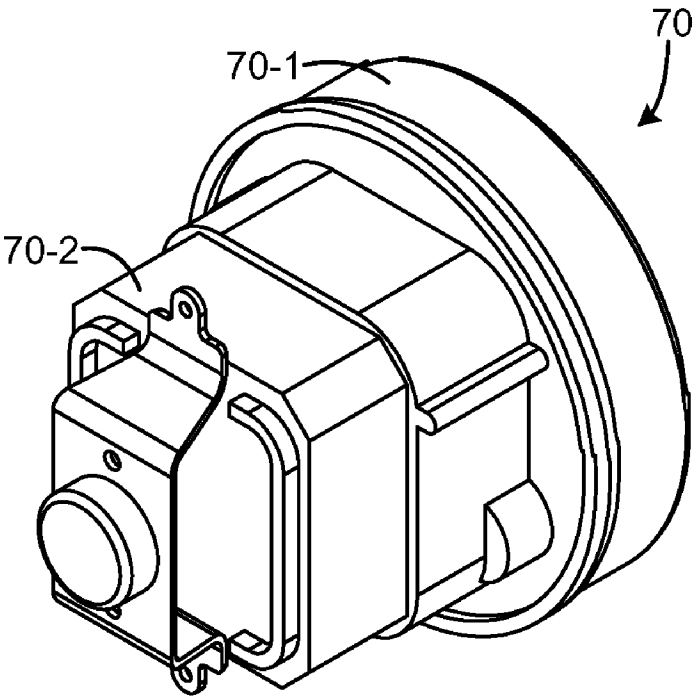
FIGS. 6A and 6B are isometric front side and back side views of an exemplary embodiment of a motor and impeller assembly.
Figure 6B:
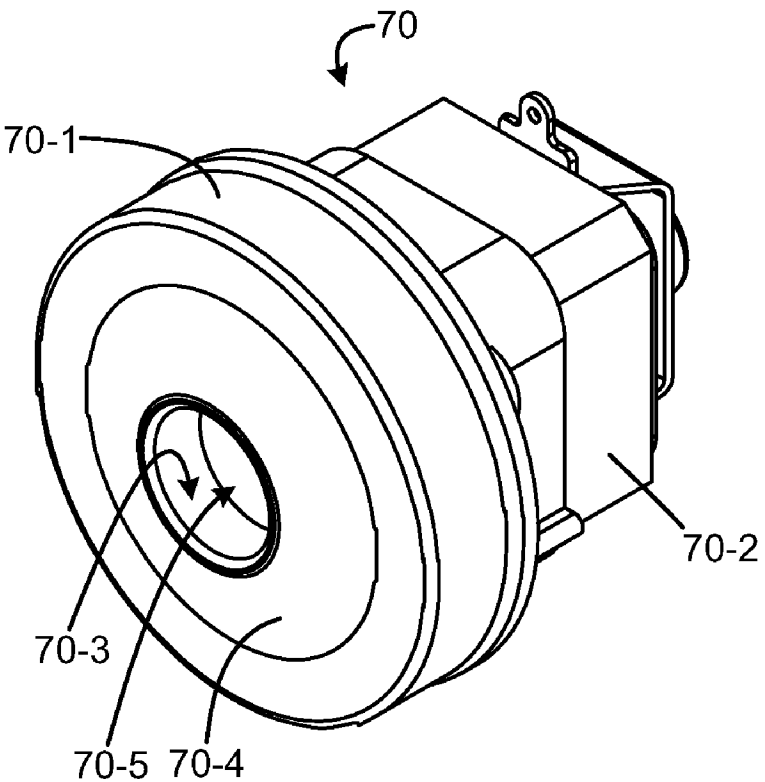

The motor assembly 70 in an exemplary embodiment includes an electric motor 70-2 which drives an impeller 70-3 inside the housing portion 70-1 (FIGS. 6A-6B). In an exemplary embodiment, the housing portion 70-1 has a generally cylindrical configuration, and the gasket 60 is sized in accordance with the dimensions of the housing portion cylindrical configuration. In other embodiments, the housing portion may take a different shape, and the gasket 60 may be adapted to the different shape. For example, the element portion 68 may be provided with slots or other openings to receive motor housing protrusions of a different motor design. In an exemplary embodiment, the gasket portion 68 may include an opening 68-1 (FIG. 5) through which supply wiring 88 may be passed to the electric motor connections.

Figure 2A:
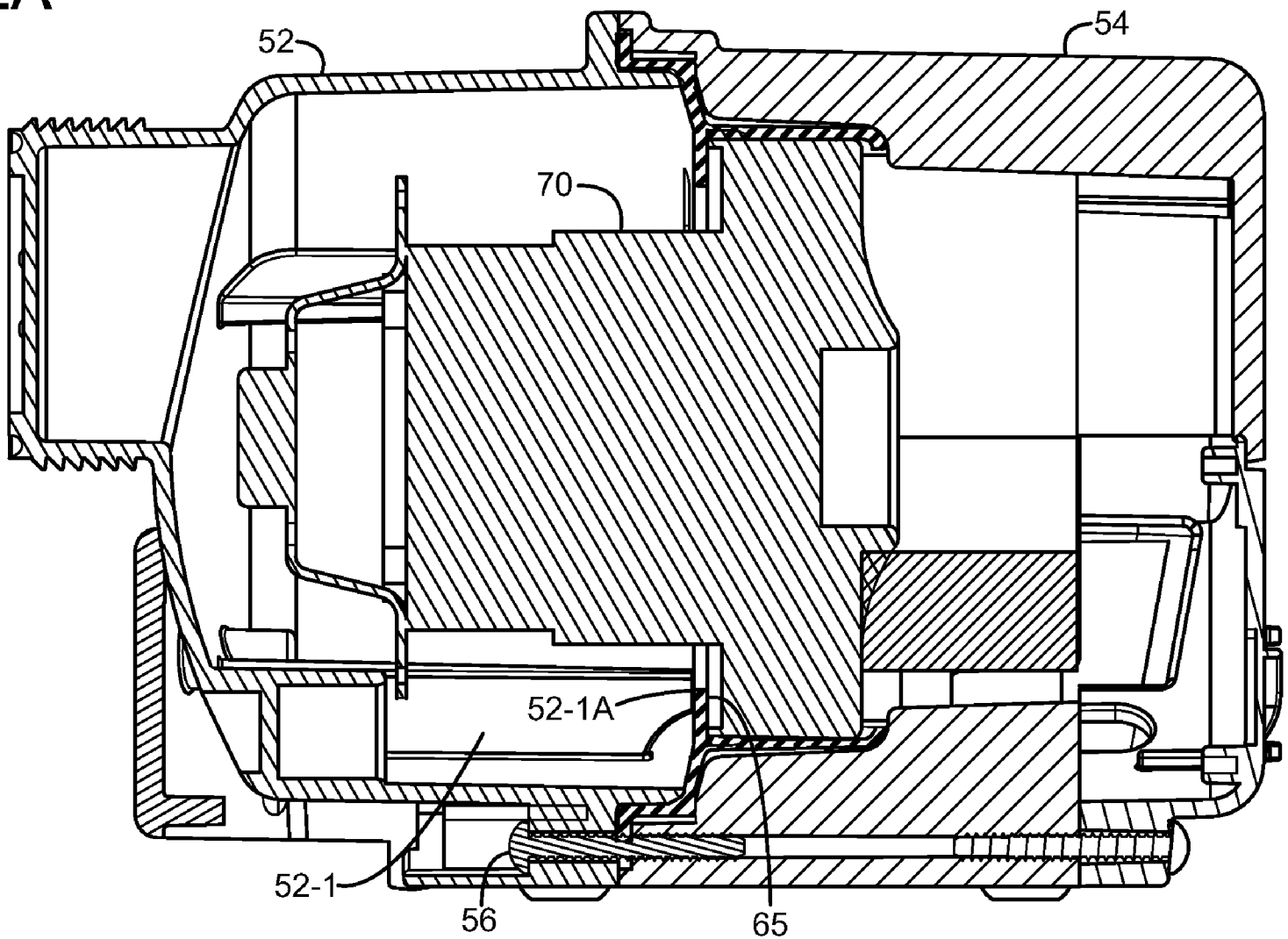
FIGS. 2A and 2B are cross-sectional views illustrating features of an air blower.
Figure 2B:
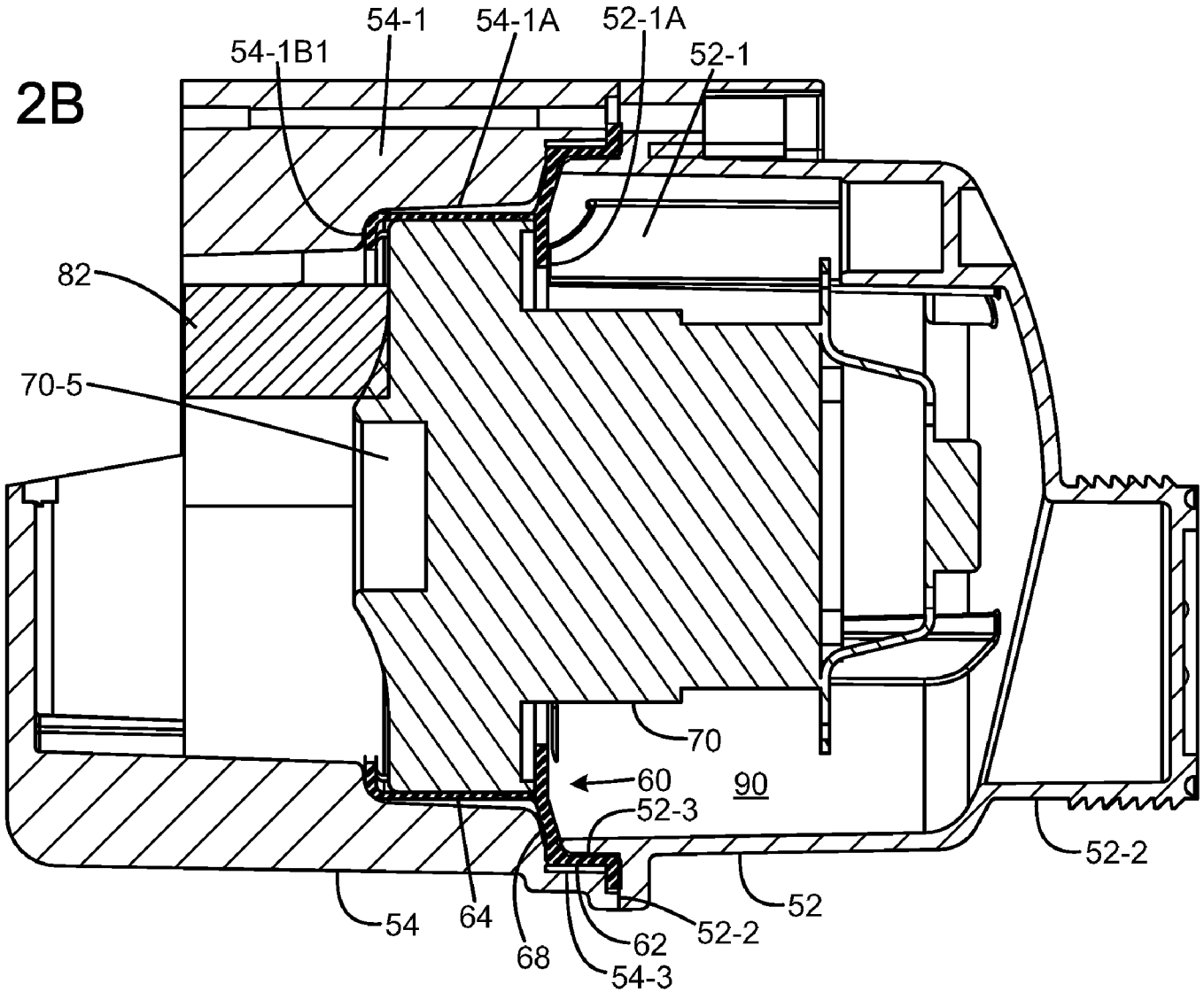
Figure 4B:
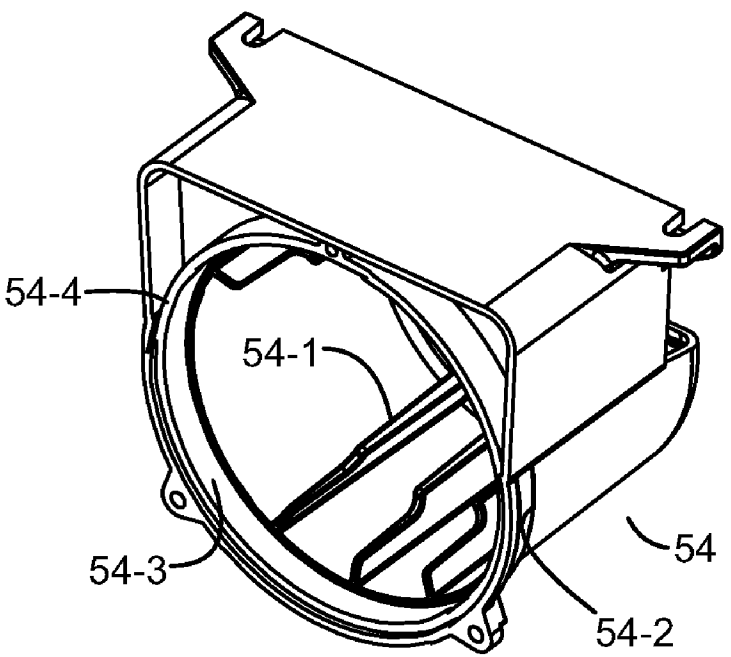
FIGS. 4A and 4B are isometric views of first and second housing structures of the air blower.
Figure 4A:
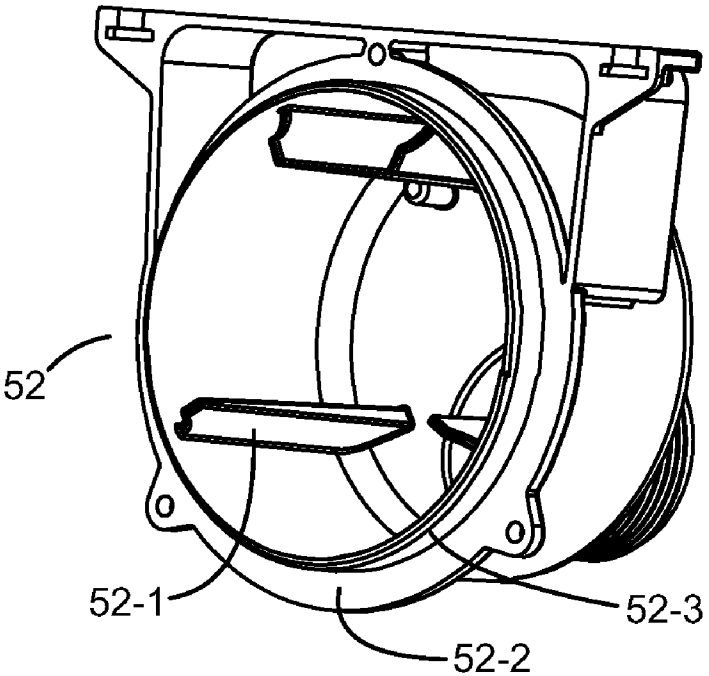
Figure 5:
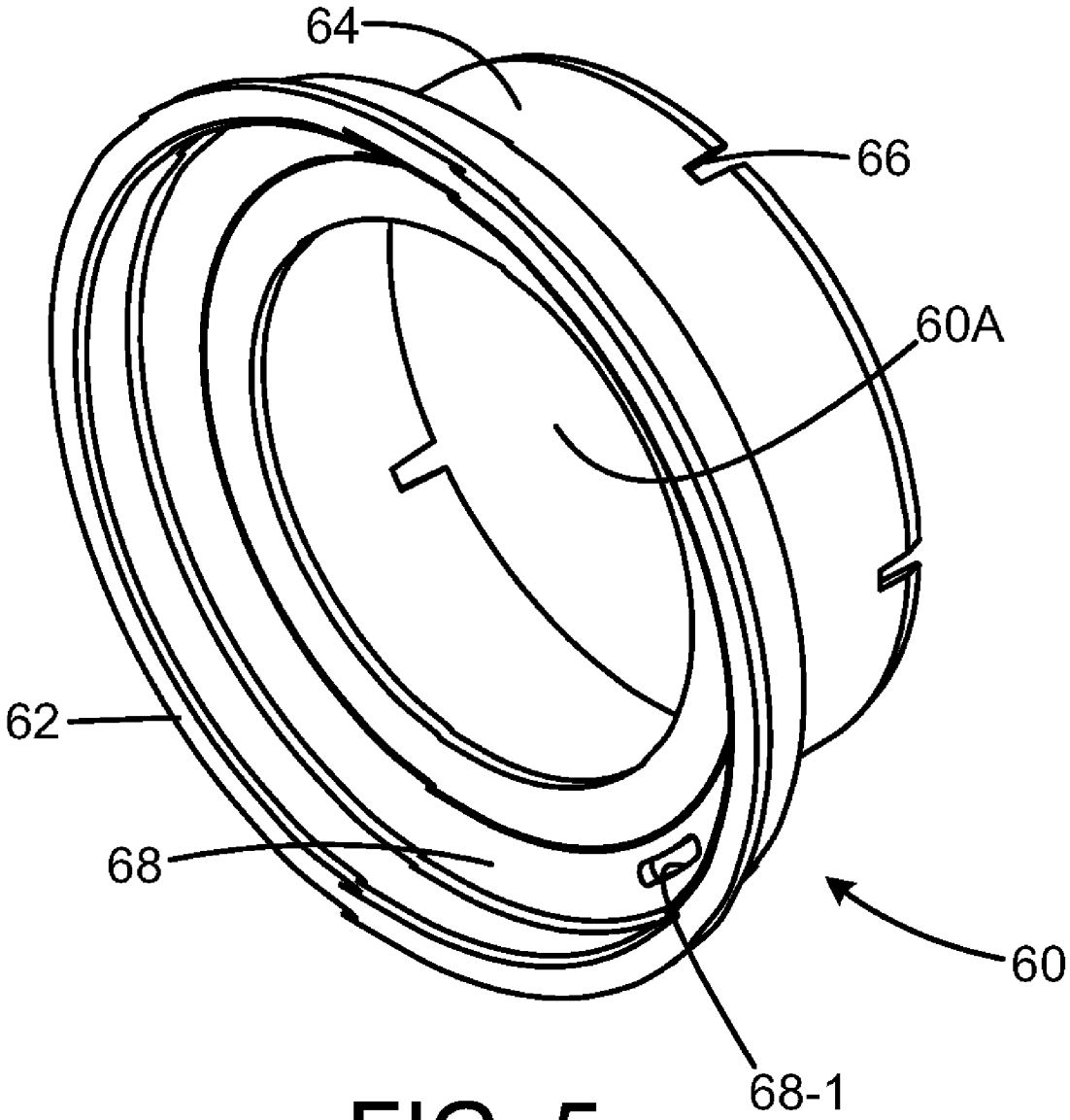
FIG. 5 is an isometric view of a sealing gasket.

The housing structures 52 and 54 include respective interlocking flange portions which mate together with the gasket 60 in an assembled condition. Housing structure 52 includes inner flange portion 52-3 and shoulder 52-2 (FIG. 4A). Housing structure 54 includes outer flange portion 54-3 and edge surface 54-4 (FIG. 4B). When the housing structures are assembled together, e.g. as shown in FIGS. 2A-2B, the flange portion 62 of the gasket 60 is captured between the inner and outer flange portions 52-3 and 54-3, and the edge surface 54-4 is brought against shoulder surface 52-2. The threaded fasteners 56 draw the housing structures together and compress the flange portion 62 of the gasket in a sealed arrangement.

The housing structures 52 and 54 each have inwardly facing, spaced longitudinal ribs. Thus, housing structure 52 includes spaced ribs 52-1, and housing structure 54 has spaced ribs 54-1.

The spaced ribs 54-1 on the second housing structure 54 define rib surfaces 54-1A configured to capture the motor housing portion 70-1 and gasket 60 in a radial sense in an interference fit, with the surfaces 54-1A being generally oriented in a longitudinal sense, with a slight draw or taper so that interference contact of the rib surface with the housing portion 70-1 and gasket 60 increases as the motor housing is inserted into the housing 54. The ribs 54-1 also include shoulder features 54-1B at the base of the rib surface 54-1A to axially capture the motor housing portion 70-1 to prevent further axial movement toward the interior of the second housing structure 54. The shape of the rib surfaces 54-1A and 54-1B may also be configured to contact the tubular portion of the gasket to roll the end of the gasket over the end of the motor housing (FIG. 2B).

The spaced ribs 52-1 in the first housing structure 52 are configured to contact the motor assembly 70 to prevent axial movement of the motor toward the outlet port 52-2 of the first housing structure 52. In this embodiment, the end surfaces 52-1A of the ribs 52-1 are configured to contact and compress the inner edge 65 of the gasket against the motor housing (FIG. 2A).

With the motor assembly installed in the two housing structures 52 and 54, the ribs 52-1 and 54-1 in the housing structures serve to register the radial and axial positions of the motor assembly 70 inside the blower housing without the use of separate clamp fastener device, with the gasket 60 providing sealing between the two housing structures.

In operation, the motor assembly 70 is configured to draw air into port 70-4 of the motor assembly 70 and expel air out of the outlet port 52-2. The first housing structure 52 may be configured as a pressure side of the blower assembly with an outlet port 52-2 through which pressurized air is delivered by the blower assembly under operating conditions. The second housing structure 54 may be configured as an inlet side of the blower assembly into which air is drawn by action of the motor assembly 70. The particular path of the air from the inlet port 70-4 to the outlet port 52-2 may be dependent on the particular design of the motor assembly 70. One exemplary air flow path is illustrated in FIG. 3, in which air is drawn through foam elements 80 and 82, into port 70-4 of the motor assembly 70, through or around the motor into the plenum area 90 (FIG. 2B) inside housing structure 52 and out the outlet port 52-2. For some motor designs, the air may be flown by the impeller 70-3 around the motor shaft and armature to cool the motor and into plenum 90.

Some embodiments of a blower may include other features, such as a circuit assembly mounted, e.g. on or adjacent to the cover 86 to control features of the blower assembly, e.g. motor speed or a blower purge cycle. Further, a heater element may be placed in the output side of the blower assembly, e.g. a resistive heating element mounted within plenum 90 of the housing structure 52, to provide an air heating function.

Although the foregoing has been a description and illustration of specific embodiments of the subject matter, various modifications and changes thereto can be made by persons skilled in the art without departing from the scope and spirit of the invention.

What is claimed is:

1. An air blower comprising:

an electrically powered motor and impeller assembly including a motor housing;

a blower housing comprising first and second housing structures, each having inwardly facing, spaced ribs, and configured to support the electrically powered motor and impeller assembly in an assembled configuration;

a sealing gasket including a flange portion captured between respective mating flange surfaces of the first and second housing structures and a tubular gasket portion extending into the second housing structure, into which the motor housing is fitted;

the inwardly facing, spaced ribs of each of the first and second housing structures configured to determine the radial and axial position of the motor housing inside the blower housing, with the sealing gasket providing sealing between the first and second housing structures; and wherein the tubular gasket portion has a longitudinal length to extend past the motor housing and has a plurality of slots formed at a distal end, and wherein the inwardly facing, spaced ribs of the second housing structure are configured to contact the tubular gasket portion of the sealing gasket to roll the distal end of the sealing gasket over an end of the motor housing.

2. The blower of claim 1, wherein the inwardly facing, spaced ribs on the second housing structure are configured to capture the motor housing and sealing gasket in a radial sense in an interference fit.

3. The blower of claim 1, wherein the inwardly facing, spaced ribs on the second housing structure include features to axially capture the motor housing to prevent axial movement toward the interior of the second housing structure.

4. The blower of claim 1, wherein the inwardly facing, spaced ribs on the first housing structure are configured to contact the electrically powered motor and impeller assembly to prevent axial movement of said electrically powered motor and impeller assembly toward the interior of the first housing structure.

5. The blower assembly of claim 1, wherein the motor assembly is secured in position within the blower housing by cooperative engagement of the motor assembly with said inwardly facing, spaced ribs of each of the first and second housing structures and said sealing gasket, without the use of separate clamps or fasteners.

6. The blower assembly of claim 1, wherein the sealing gasket is fabricated from a flexible elastomeric material.

7. The blower assembly of claim 1, further comprising an intake foam element disposed adjacent an intake port of the electrically powered motor and impeller assembly to provide sound insulation and filtration functions.

8. An air blower comprising:

an electrically powered motor assembly including a motor housing;

a blower housing comprising first and second housing structures, each having inwardly facing, spaced ribs, and configured to support the motor assembly in an assembled configuration;

the first housing structure configured as a pressure side of the blower with an outlet port through which pressurized air is delivered by the blower under operating conditions, the second housing structure configured as an inlet side of the blower through which air is drawn by action of the motor assembly;

a sealing gasket defining an inner opening and a tubular gasket portion sized to receive the motor housing in a tight fit, the sealing gasket further including a flange portion captured between respective mating flange surfaces of the first and second housing structures;

the inwardly facing, spaced ribs of each of the first and second housing structures configured to determine the radial and axial position of the motor housing inside the blower housing, with the sealing gasket providing sealing between the first and second housing structures; and wherein the electrically powered motor assembly is secured in position within the blower housing and within the inner opening and tubular gasket portion of the sealing gasket by cooperative engagement of the electrically powered motor assembly with said inwardly facing, spaced ribs of each of the first and second housing structures and said sealing gasket, without the use of separate clamps or fasteners; and wherein the tubular gasket portion has a longitudinal length to extend past the motor housing and has a plurality of slots formed at a distal end, and wherein the inwardly facing, spaced ribs of the second housing structure are configured to contact the tubular gasket portion of the sealing gasket to roll the distal end of the sealing gasket over an end of the motor housing.

9. The blower of claim 8, wherein the inwardly facing, spaced ribs on the second housing structure are configured to capture the motor housing and sealing gasket in a radial sense in an interference fit.

10. The blower of claim 8, wherein the inwardly facing, spaced ribs on the second housing structure include features to axially capture the motor housing to prevent axial movement toward the interior of the second housing structure.

11. The blower of claim 8, wherein the inwardly facing, spaced ribs on the first housing structure are configured to contact the electrically powered motor and impeller assembly to prevent axial movement of said motor and impeller assembly toward the first housing structure.

12. The blower of claim 8, wherein the sealing gasket is fabricated from a flexible elastomeric material.

* * * * *